United States Patent [19]

Wallace

[11] 4,135,455

[45] Jan. 23, 1979

[54] MULTIPLE PAYLOAD CARTRIDGE EMPLOYING SINGLE PAIR OF ELECTRICAL CONNECTIONS

[75] Inventor: David W. Wallace, Austin, Tex.

[73] Assignee: Tracor, Inc., Austin, Tex.

[21] Appl. No.: 765,245

[22] Filed: Feb. 3, 1977

[51] Int. Cl.[2] ..... F42C 11/00; F42B 13/50

[52] U.S. Cl. ..... 102/217; 102/89 CD

[58] Field of Search ..... 102/70.2 R, 70.2 A, 102/89 CD, 21.6, 20, 34.5, 37.7; 89/1.5 R, 1.5 E, 1.5 F; 175/4.55

[56] References Cited

U.S. PATENT DOCUMENTS

| | | | |
|---|---|---|---|
| 2,297,006 | 9/1942 | Lohman | 102/70.2 R |
| 2,824,496 | 2/1958 | Kuller et al. | 102/70.2 R |
| 2,832,265 | 4/1958 | Reid et al. | 102/70.2 R |
| 2,871,784 | 2/1959 | Blair | 102/70.2 R |
| 3,010,396 | 11/1961 | Coleman | 175/4.55 |
| 3,122,058 | 2/1964 | Wyser | 102/70.2 R |
| 3,246,708 | 4/1966 | Harrigan, Jr. et al. | 175/4.55 |
| 3,262,388 | 7/1966 | McCarty | 102/70.2 R |
| 3,451,306 | 6/1969 | Lagerstrom et al. | 89/1.5 R |
| 3,815,271 | 6/1974 | Lynn | 102/70.2 R |

*Primary Examiner*—Charles T. Jordan

*Attorney, Agent, or Firm*—Arnold, White & Durkee

[57] ABSTRACT

A multiple payload cartridge employing circuit components in the squib portion thereof to allow for separate or sequential firing thereof, and hence separate payload ejection, through two-wire connections. Various techniques include the use of a repositionable switch to provide sequential ground connections; the use of mechanical interrupters, e.g., spring-type, crushable-element-type or domed-pop-action type; the use of resistive voltage dividers to permit discrimination in squib firing via applied voltage amplitudes; the use of diodes to permit discrimination in squib firing via applied voltage polarities; and combinations of the above.

14 Claims, 13 Drawing Figures

FIG. 4
TYPICAL IMPLEMENTATION
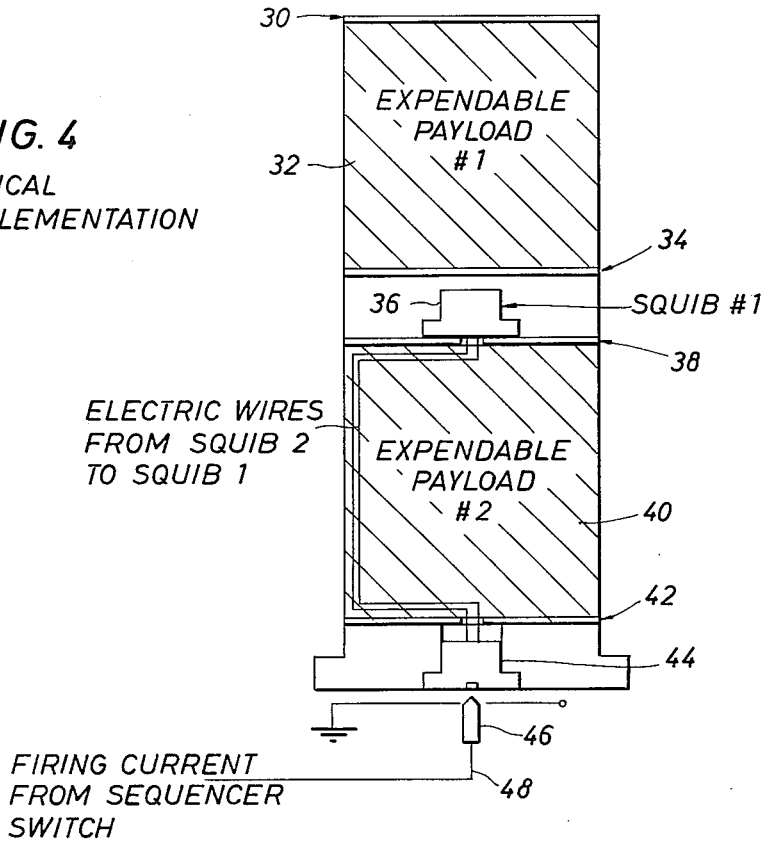
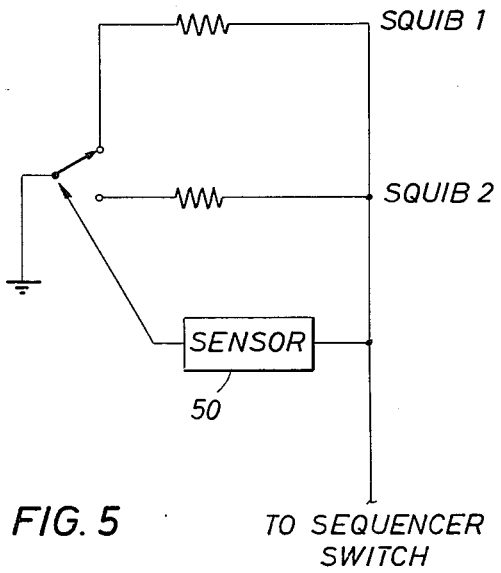
FIG. 5
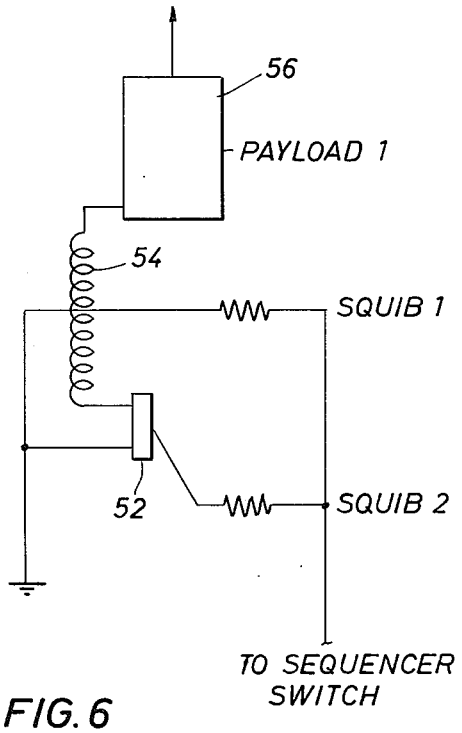
FIG. 6

MULTIPLE PAYLOAD CARTRIDGE EMPLOYING SINGLE PAIR OF ELECTRICAL CONNECTIONS

BACKGROUND OF THE INVENTION

1. Field of the Invention

This invention pertains to multiple payload cartridges suitable for ejecting expendable payloads of chaff or the like and more specifically to such cartridges connectable for ejection ignition using two wires in the place of a minimum of three wires heretofore required.

2. Description of the Prior Art

A typical chaff dispenser carries 30 expendable payload units or cartridges, although dispensers having fewer and more than this number are also common. Each of such units is typically a square in cross section and about 8 inches long although other configurations exist. The payload may be chaff dipoles of varying lengths, although other expendable payloads suitable for operating in conjunction with cartridges hereinafter described include infrared flares, smoke producing payloads, photoflash plates, expendable jammers, propaganda leaflets, fertilizer, grass seeds and the like.

Each payload unit may be likened to a shotgun shell having an expendable payload which is ejected and having a liner which remains in the dispenser after the payload is ejected.

The dispensing mechanisms vary, but the most common type includes a pyrotechnic ejection system. Such a system uses an applied electrical signal to heat a bridge wire in a pyrotechnic gas generator referred to as a "squib" or sometimes as an "impulse cartridge". The heated, resistive bridge wire ignites the propellant charge in the ejection squib and the resultant gas pressure ejects the payload from the cartridge or unit. Thus, the system operates much like an electrically initiated shotgun shell.

The squib case holds all of the parts of the dispensing or ejection system and serves as electrical ground connection. The closure disc retains the propellant in the main chamber of the squib until the propellant is ignited, at which time the closure disc is ruptured by the gas pressure generated by the burning propellant. An electrical contact post, insulated from the squib case by a glass or plastic insulator, provides "hot wire" connection to an applied triggering current. The bridge wire is welded to the electrical contact post and to the squib case. Other squib configurations also exist.

When a proper electrical signal is applied between the electrical contact post and the squib case, the bridge wire is heated up and ignites the propellant. The burning propellant generates gas pressure which ruptures the closure disc allowing the gas to pressurize the volume underneath the piston in the payload liner. The piston transmits a pushing force to the payload and, therethrough, to the end cap. The end cap is forced out of the payload liner and then the payload is forced out of the payload liner (i.e., ejected) by the moving piston, which is also ejected.

The dispenser carrying the multiple cartridges are electrically connected so that each cartridge receives its signal, in turn, from an electrical contact of a "sequencer" switch, typically a rotary switch or equivalent, which moves from one position to the next.

Existing dispenser systems fall into one of two categories. The first category are those systems wherein a single expendable payload is put into each hole of the system. The second category are those dispenser systems that put multiple expendable payloads into each hole of the dispenser.

For the single-expendable-payload-per-hole dispenser systems, a common ground is normally employed for the cartridges, which is most often the chassis of the aircraft, or other vehicle. The connections to the sequencer switch include one hot wire running from a separate contact on the sequencer to each hole of the dispenser, thereby providing means for sequentially and separately electrically triggering the squibs. The sequencer, as noted above, functionally operates as a rotary switch with a movable contact that moves through the individual cartridge connections, providing firing current, one at a time, to each individual squib. The firing current heats the bridge wire to ignite the ejection charge, which causes ejection of the payload. Thus, one pair of electrical contacts is all that is required for each cartridge in such a system.

In the case of prior art dispenser systems using multiple expendable payloads per hole (cartridge), the wiring is more complex. For simplicity, assume only two payloads in each dispenser hole. In such case, a common ground may be employed; however, two "hot" electrical connections have heretofore been connected to each cartridge, one to the squib operating in conjunction with each payload. Therefore, two hot electrical connections or "firing" pins are required to each dispenser hole to make contact with the ignitors of the dual payloads. Hence, such a system is a three-wire system with three contacts for each hole (two hot connections and one ground connection). Such a system could also use one hot electrical connection and switch the ground between the squibs in the sequencer switch, but three wires would still be required to each hole.

Other variations in the prior art have included as many as four payloads stacked end-to-end in each hole. As can be seen, this has required at least five electrical contacts (four hot contacts and one common ground) for each hole.

As technology has advanced, it has become possible to achieve the desired expendable payload characteristics with smaller expendables. For example, if two expendables could be installed in the place of one, system effectiveness would be vastly increased since more expendables could be carried in the same dispenser volume. In order to minimize modification of existing dispensing systems, it is preferable to avoid physically modifying the dispenser units and aircraft wiring and to instead modify the dispenser electronics (e.g., the sequencer electronics) and/or the expendable unit electronics (i.e., the squib-related electronics) to allow two-wire operation for separately igniting the multiple payloads in a single cartridge.

Therefore, it is a feature of the present invention to provide an improved multiple payload cartridge input connection for separate ignition of the payloads therein using only two wires for connection thereto.

It is another feature of the present invention to provide an improved multiple payload cartridge having means for ensuring against the simultaneous ignition of the squibs therein by a single applied electrical pulse, and having means for igniting squibs individually upon command.

SUMMARY OF THE INVENTION

A first embodiment of the present invention uses an electrical sensor and switch with first and second squibs connected respectively to first and second payloads.

The switch provides a ground to the first squib so that when a firing pulse is applied, this squib is ignited. The sensor senses this first firing pulse and, when terminated, repositions the switch to provide a ground to the second squib. This second squib is then ignited by a subsequent pulse. Alternately, a pyrotechnically activated element repositions the switch to connect with the second squib following a predetermined period following the receipt of the first pulse.

A second embodiment of a dual payload system involves the wiring of the squibs in parallel, one being wired through a normally opened mechanical interrupter. Ejection of the first payload causes a resilient contact to close, or an insulation element to crush, or a pop element to close to connect the second squib for ignition firing following termination of the first firing pulse.

A third embodiment utilizes the use of firing pulses of different amplitudes by connecting the squib circuits in parallel, but, in a dual payload embodiment, one such circuit includes a resistive element. Hence a voltage of low amplitude ignites the first squib without the second. A subsequent larger voltage ignites the second squib.

A fourth embodiment utilizes the use of firing pulses of different polarities by connecting the squib circuits in parallel, but, in a dual payload embodiment, one such circuit includes a diode. Hence a voltage of one polarity ignites the first squib and a voltage of opposite polarity ignites the second after the first payload has already been ejected.

Combination of resistors and diodes permit separate firing of multiple payloads in excess of two using voltages varying in both amplitude and polarity.

BRIEF DESCRIPTION OF THE DRAWINGS

So that the manner in the above-recited features, advantages and objects of the invention, as well as others which will become apparent, are attained and can be understood in detail, more particular description of the invention briefly summarized above may be had by reference to the embodiments thereof which are illustrated in the appended drawings, which drawings form a part of this specification. It is to be understood, however, that the appended drawings illustrate only typical embodiments of the invention and are therefore not to be considered limiting of its scope, for the invention may admit to other equally effective embodiments.

In the Drawings:

FIG. 4 is a schematic cross sectional view of a double payload cartridge in accordance with the present invention.

FIG. 5 is an electrical schematic diagram showing the connections of dual payload squibs in an embodiment of the present invention.

FIG. 6 is an electrical schematic diagram showing the connections of dual payload squibs in another embodiment of the present invention.

DESCRIPTION OF THE PREFERRED EMBODIMENTS

Figure 1:
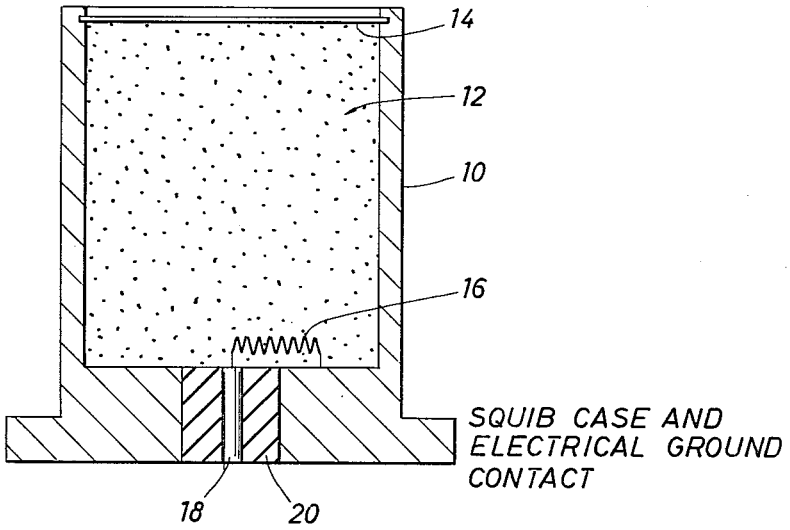
FIG. 1 PRIOR ART
FIG. 1 is a cross sectional view of a typical squib case including electrical ground contact as employed in the prior art.

Now referring to the drawings and first FIG. 1, a squib case, typical in the prior art, is illustrated. Case 10 is generally annular in configuration and elongated, the main chamber of the squib case being filled with a suitable propellant 12. The end of the case adjoining the payload ejection piston (not show) is closed by a suitable closure disc 14, the disc readily rupturable upon the ignition of propellant 12.

Squib case 10 is normally made of a soft, electrically conductable metal. As will be explained more fully hereinafter, the squib case itself normally acts as an electrical ground contact. Some squibs use two electrical leads (one hot and one ground) and a case made from insulating materials, but the disclosures contained herein are still applicable to them.

An electrical bridge wire 16 is connected in the bottom of the propellant chamber of the squib case and is connected between the case and a "hot wire" electrical post 18, which is insulated from the case by annular insulation 20 surrounding the post. Post 18 may include any suitable resilient or spring-type female contact for receiving a pin for connecting the squib to a suitable electrical circuit for firing.

As described earlier, a dispenser includes a plurality of holes or units for being loaded as cartridges with the main expendable payloads and, if required, main charges. (It should be noted that in most applications a main charge is not necessary, since the propellant contained within the squib is sufficient to discharge the payload from the cartridge without need of a further charge.)

Figure 2:
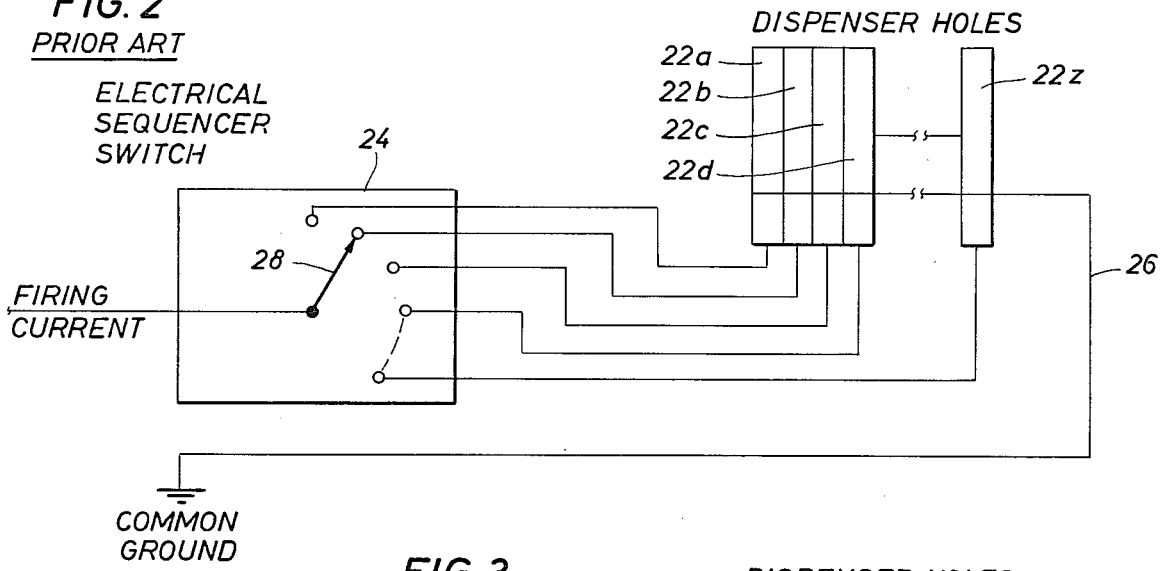
FIG. 2 PRIOR ART
FIG. 2 is an electrical schematic diagram showing electrical connections through a sequencer switch to a plurality of single payload cartridges, as employed in the prior art. This function can also be performed by other means including solid state electronic switching.

In any event, FIG. 2 illustrates a plurality of dispenser holes 22*a*, 22*b*, 22*c*, 22*d* . . . 22*z*, each having a suitable squib in the bottom thereof connected by a hot wire to electrical sequencer switch 24. The dispensers holes are all connected via their squib cases to a common electrical ground 26, although some systems use individuals grounds.

The electrical sequencer switch is typically a rotary switch having a plurality of contacts sequentially and separately actuated by a rotating contact 28, which, in turn, is connected to the applied firing current. In operation of the circuit in FIG. 2, an applied firing current, which may be either ac or dc, is applied to the sequencer switch while the rotary arm is swept through the contacts. The applied current to a squib heats each of the respective bridge wires, in turn, to a sufficient degree to ignite the propellant in the related squib. Note that in FIG. 2 there are two wires to each dispenser hole, one a hot wire to the electrical sequencer switch and one a ground wire.

Figure 3:
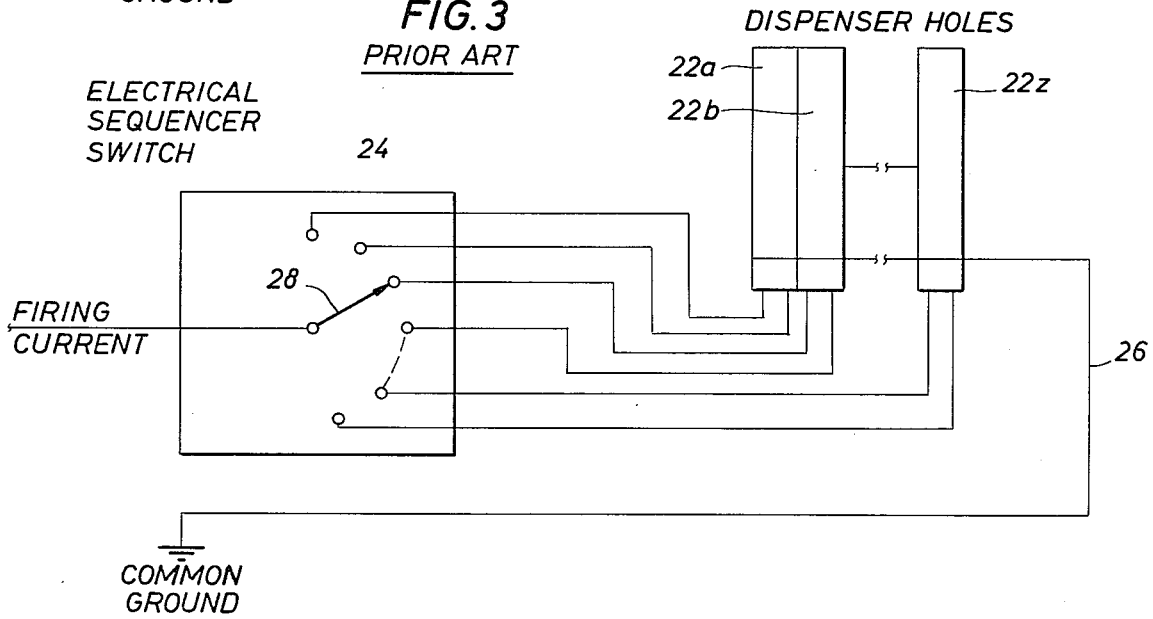
FIG. 3 PRIOR ART
FIG. 3 is an electrical schematic diagram showing electrical connections through a sequencer switch to a plurality of double payload cartridges, as employed in the prior art.

Referring now to FIG. 3, a dispenser is illustrated which is loaded so that each hole therein includes a dual payload. Each payload within a hole has connected therewith its own squib, so that the ignition of the squib operating with the payload nearest the exit end of the dispenser hole, is ignitable without igniting the other squib, thereby causing the ejection of only one payload. After the first payload has been ejected, then, using a second wire from the sequencing switch, the second squib is ignited to eject the second payload from the dispenser hole.

As may be seen, two hot wires are connected between the sequencer switch 24 and each of the dispenser holes, one hot wire being connected to each of the two squibs, respectively.

With the same number of dispenser holes as illustrated in FIG. 2, it is possible to double load the dispenser so as to include twice the number of payloads.

Operation of the sequencer for FIG. 3 is essentially identical to the operation of the sequencer switch in FIG. 2 in that when the rotary contact 28 is swept through its positions, one payload at a time is ejected from the dispenser unit.

Now referring to FIG. 4, a schematic representation of a dual payload cartridge (the loading of a hole or unit in the dispenser) is illustrated. The discharge end of the cartridge illustrated is closed with end cap 30 to hold expendable payload #1 32 within the cartridge. A piston 34 is housed within the cartridge for activation by squib #1 36. That is, with the ignition of the propellant of squib #1 the disc closure thereof, which is essentially concentric with the opening of the squib, ruptures to cause a gas force against piston 34. Piston 34 has a much greater area than the end of the squib, essentially the same dimension as the inside of the cartridge housing the payload.

In similar fashion to payload #1, end cap 38 closes the part of the cartridge housing expendable payload #2 40. Piston 42 is actuated by squib 44 to eject expendable payload #2 40.

Internal wiring of the cartridge includes two wires from squib #1 (one to its center post and one to its casing ground). These electrical connections pass through end cap 38 in a very small hole therein, preferably in the vicinity of the center. The electrical connections to squib 36 are made from squib 44 through a tiny central hole in piston 42. The specific connections are described more fully hereinafter with respect to the various schematic diagrams illustrated below.

Ground contact is made to the casing of squib 44 by a suitable means such as a spring type contact or a direct connection. A spring loaded electrical contact pin 46 is typically employed to connect with the electrical post of squib 44, this pin being connected to hot wire 48 leading to the sequencer switch. The connection through the sequencer switch to a suitable power source is in the same manner as described above with respect to the prior art systems. The difference is that the source produces sequential firing for more than one payload before the sequencer switch is stepped to a subsequent position. Note that only two electrical connections are made to the cartridge, one being a common ground connection and one being a single hot wire connection, even though the cartridge is loaded with a dual payload.

A first circuit for providing separate firing currents to squib #1 and squib #2 is illustrated in FIG. 5, wherein the resistive bridge wire connections in these squibs, which are represented by electrical resistor symbols in the illustration, are connected in parallel through an electro-mechanical sensor 50. The switch contacts of sensor 50 are connected to provide an initial ground to squib #1. A firing signal applied from the sequencer switch to squib #1 is sensed by sensor 50 to reposition the contacts of the sensor to provide a ground for squib #2 to enable it to be actuated upon the application of a subsequent firing signal from the same connection on the sequencer switch. So as to prevent premature firing of squib #2, either a delay element is included in the sensor so as to prevent repositioning from occuring until after the application of the firing signal to squib #1, or the actuation is on the trailing end of the applied signal, rather than on its initiation. Please also note whereas a dc or pulsed signal may be used in the prior art to provide the firing current, the circuit illustrated in FIG. 5 is actuated by either a pulse signal or a signal which is interrupted. Please also note that sensor 50 and its associated switch contacts are installed within the payload cartridge such that only two electrical contacts or connections must be made to the cartridge.

In addition to the use of an electro-mechanical sensor for sensor 50, it is also possible to employ a pyrotechnically actuated switch. In this event, when squib #1 ignites and ejects the first payload, the pyrotechnic element is also lit. When the delay column therein expires, a charge is ignited to reposition the switch portion to provide the ground to the second squib. This second squib is then fired at the arrival of the next pulse from the sequencer switch.

Please note also that the sequencer switch is left in a single position while both payloads are actuated sequentially and then it is moved to actuate the payloads in a subsequent dispenser cartridge.

Figure 11:
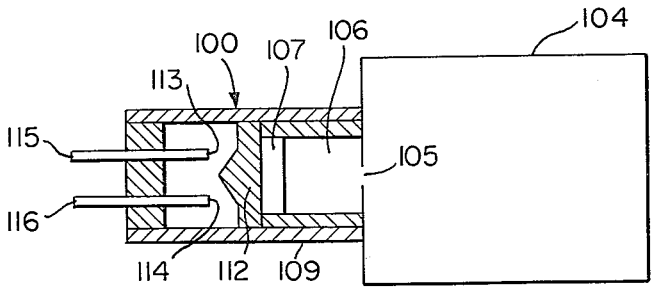
FIG. 11 illustrates a pyrotechnic delay column useful for repositioning the ground.

In a particular embodiment illustrated in FIG. 11, a switch 100 is shown which utilizes a pyrotechnic delay technique. Switch 100 is shown in association with a typical squib 104. Switch 100 and squib 104 communicate by means of a port 105. Switch 100 includes a case 109 which houses a pyrotechnic delay column 106, an output charge 107, a copper contact wedge 112 and the contact portions 113, 114 of a pair of switch leads 115, 116. Switch 100 is normally open. Upon firing of squib 104 the output from the squib ignites column 106 through port 105. When the ignited edge of column 102 reaches output charge 107 the charge is ignited thereby driving wedge 112 into contact portions 113, 114 to close the switch. The next successive squib is then connected to ground for firing by the next firing pulse.

The circuit in FIG. 6 illustrates another means of implementing the firing of the first and second squib in sequential manner. In this case, the two squibs are again wired in parallel, one squib being wired through a mechanical interrupter 52, which is spring loaded to the first payload 56. Again, squib #1 is initially provided with a ground and squib #2 is disconnected from ground.

When payload #1 is ejected by a squib #1, the mechanical interrupter is actuated by spring 54 to provide a ground to squib #2. A mechanical delay can be provided to prevent premature firing of the second squib before the next firing pulse arrives.

Variation in the arrangement just described may include a reaction switch in place of interrupter 52 that includes a crushable element, which is crushed by the forces generated when the first payload squib fires to provide the ground contact for squib #2.

Figure 12:
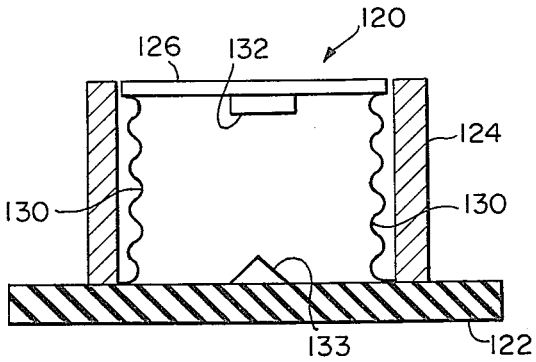
FIG. 12 illustrates a reaction switch including a crushable element which is crushed by the firing of a squib for repositioning the ground to the next squib.

In a particular embodiment illustrated in FIG. 12, a reaction switch 120 is shown which is activated by the crushing of an element in response to the firing of a squib. Reaction switch 120 includes an insulated base 122 and connected housing 124. A platten 126 is slidably positioned within housing 124 and restrained against motion toward base 122 by crushable element 130. Switch contacts 132, 133 are positioned on platten 126 and base 122 respectively and are electrically connected by conductors (not shown) to the circuitry. In operation, the exterior surface of platten 126 is exposed to the gas pressure force created by the firing of a squib (not shown). This force serves to crush element 130, thereby bringing contacts 132, 133 together to close the switch. The closed switch provides a ground contact for the next successive squib.

Another variation of the mechanical interrupter shown in FIG. 6 is provided by using a switch with a domed pop action. In this case, the reaction forces pop the normally open switch to squib #2 to the closed position.

Figure 13:
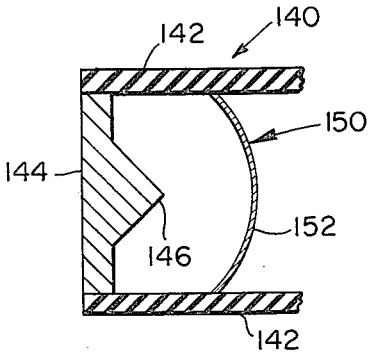
FIG. 13 illustrates a reaction switch including a domed pop element which is actuated by the firing of a squib to reposition the ground to the next squib.

One embodiment of a reaction switch including a domed pop element is illustrated in FIG. 13. Switch 140 includes an insulated housing 142 which houses a metallic contact carrier 144 having a contact 146. A bi-stable metallic diaphragm 150 is supported by the walls of housing 142 and forms the second contact of switch 140. Switch 140 is shown in the open position in FIG. 13 with contacts 146 and 150 spaced apart. The outer surface 152 of diaphragm 150 is exposed to the gas pressure force created by the firing of a squib (not shown). This force is sufficient to pop diaphragm 150 through from the convex position it assumes in FIG. 13 (when viewed from the right) to a concave position where it is also stable and in electrical contact with contact 146. The pop action of diaphragm 150 serves to close switch 140 and provide a ground contact for the next successive squib.

Note that all of the above-described methods use two sequencer switch firing pulses with the same nominal electrical characteristics. The two firing pulses are applied to the same hot electrical contact of the expendable cartridge. These methods are directly extendable to three or more payloads per cartridge.

Figure 7:
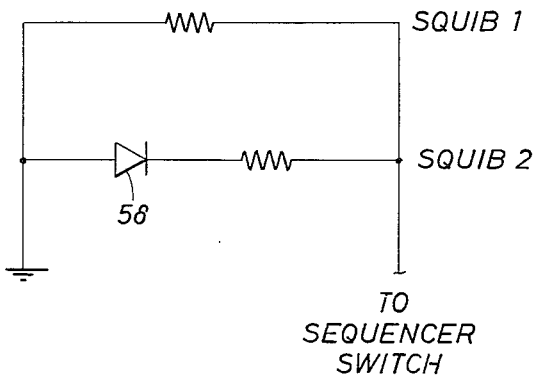
FIG. 7 is an electrical schematic diagram showing the connections of dual payload squibs in yet another embodiment of the present invention.

Now referring to FIG. 7, a technique is used employing firing pulses of different characteristics to fire first, squib #1 and then, squib #2. In this case, a diode 58 is provided in series with the bridge wire of squib #2, this series connection then being connected in parallel with the bridge wire of squib #1. A firing pulse from the sequencer switch which is negative in polarity causes the first squib to fire, but will be blocked by diode 58, and therefore the second squib will not fire. A positive pulse is permitted to pass through to the bridge wire of squib #2 to permit firing. Please note that the primary advantage of the circuit shown in FIG. 7 is that there are no electromechanical or mechanical components. However, pulsing characteristics applied to the circuit must be different for the two firing events. The diode is contained within the expendable cartridge.

Figure 8:
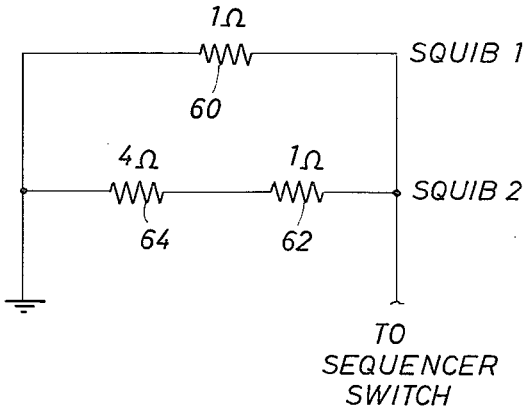
FIG. 8 is an electrical schematic diagram showing the connections of dual payload squibs in still another embodiment of the present invention.

Another means for providing an all electrical connection for sequential firing of squib #1 and squib #2 is illustrated in FIG. 8. It is assumed that the bridge wire of squib #1 has a value of 1 ohm and that the bridge wire of squib #2 62 also has a relative value of 1 ohm, compared to a resistive element 64 connected in series with the squib #2 bridge wire element 62, which has a relative value of 4 ohms. A relative low voltage will fire squib #1, but a voltage of greater value is required to provide sufficient current to squib #2 because of the added resistive element. Therefore, sequential pulses which vary in amplitude are employed to fire first squib #1 and then squib #2. Other suitable relative resistances can also be used.

Figure 9:
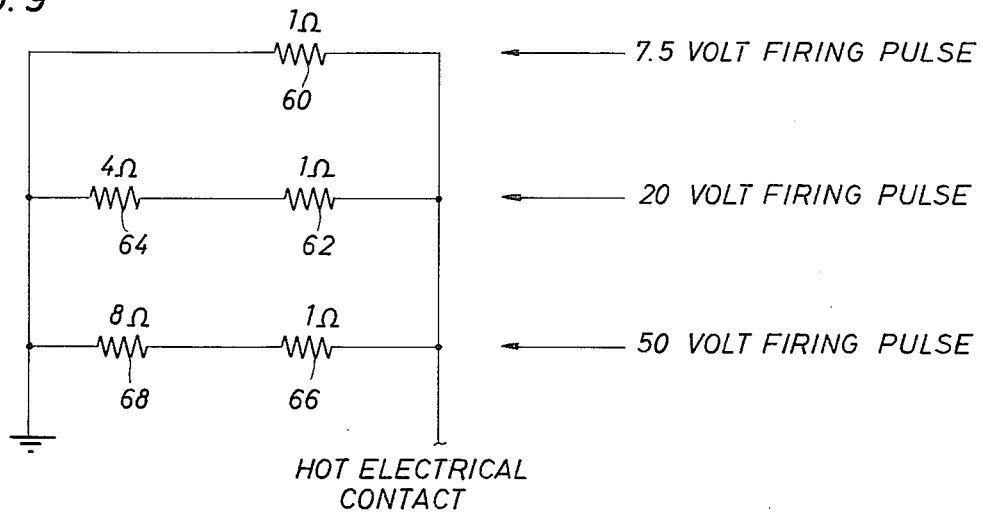
FIG. 9 is an electrical schematic diagram showing the connections of triple payload squibs in a preferred embodiment of the present invention.

By adding more resistance legs, a similar connection may be made for cartridges having more than two payloads. FIG. 9 illustrates three squibs, the first and second squib being connected as illustrated in FIG. 8 and having a third squib resistive element 66 (also of relative value of 1 ohm) in series with resistor 68, having a relative value of 8 ohms, the series connection of resistors 68 and 66 being connected in parallel with the other squib connections. As illustrated, a 7.5 volt firing pulse is sufficient to trigger squib #1, a 20 volt firing pulse is required to trigger squib #2 and a 50 volt firing pulse is required to trigger squib #3. Additional squibs could be added in similar fashion using the proper relative resistance values and the proper relative firing voltages.

Figure 10:
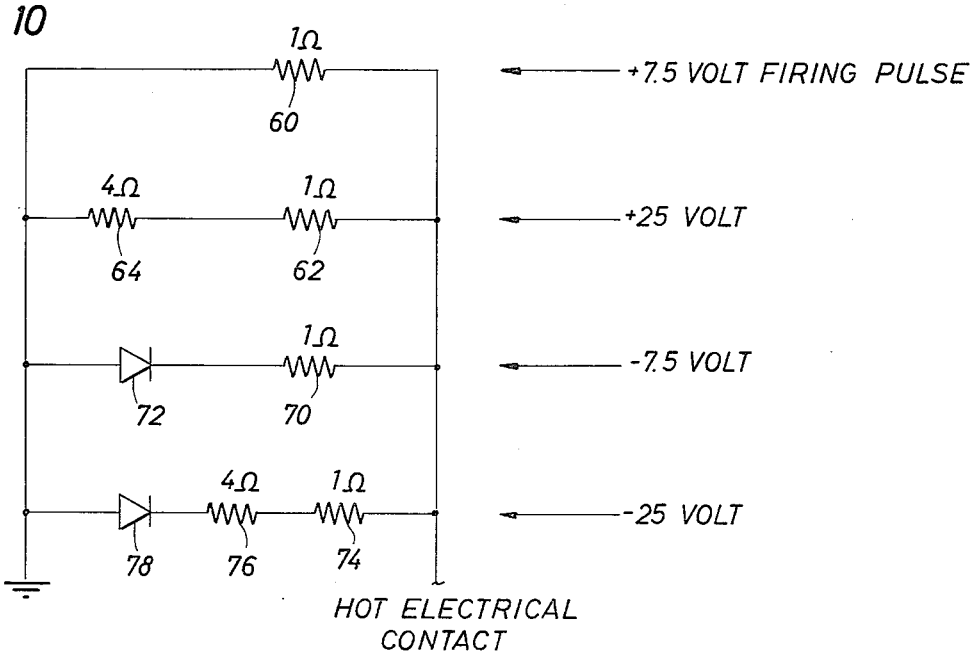
FIG. 10 is an electrical schematic diagram showing the connections of quadruple payload squibs in another preferred embodiment of the present invention.

FIG. 10 illustrates the firing of multiple squibs in a common cartridge employing a combination of techniques illustrated in FIGS. 7 and 8. In this case, squib #1 and squib #2 are connected as in FIG. 8. Squib #3 is connected so that its bridge wire 70 is connected in series with diode 72 and squib #4 is connected so that its bridge element 74 is connected in series with both a resistive element 76 and a diode 78. The squibs are again connected in parallel so that the added series component or components are included in the parallel connections in each case.

In operation, a +7.5 volt firing pulse will actuate squib #1, but will be blocked by diode 72 and diode 78 from actuating squibs #3 and #4 and will not provide a sufficient current because of resistor 64 from firing squib #2. A subsequent applied +25 volt signal will actuate squib #2, but will be blocked by diode 72 and 78 from firing squibs #3 and #4. A negative 7.5 volt signal will then trigger squib #3, but will not be of sufficient amplitude to trigger squib #4 because of resistive element 66. Finally, a negative 25 volt pulse will trigger squib #4.

While particular embodiments of the invention have been shown, it will be understood that the invention is not limited thereto. For example, the combination of the prior art connections illustrated in FIG. 3 may be combined with one of the connections illustrated in FIGS. 5 through FIG. 10 so that, for instance, four payloads in a single cartridge may be triggered using three wires.

In any event, retrofitting of cartridges so as to include additional payloads without increasing the number of electrical connection thereto may be readily achieved utilizing one or more of the techniques which have been described herein. Such a retrofit would require appropriate modifications to the sequencing switch but not to the dispenser or interconnecting wiring and, therefore, the modification would be relatively low in cost in comparison to the installation of the additional dispensers that would be needed to double the dispenser system capacity for expendable payloads.

What is claimed is:

1. A multiple payload cartridge connectable for separate ignition of the payloads therein through two connecting wires, comprising:

a first expendable payload within the cartridge including a first squib, a second expendable payload within the cartridge including a second squib, ignition means pulsed through the connecting wires connected to said first and second squibs including means for disenabling said second squib from ignition by an applied first pulse thereto suitable for igniting said first squib and enabling said second squib for ignition by an applied second pulse, and said ignition means including a switch through which the ignition pulses are applied, said switch being initially connected to said first squib and disconnected from said second squib and being operable by the first applied pulse to be connected to said second squib, said switch including a sensor for sensing the pressure of the first applied pulse and actuating the contacts of the switch to be connected to said second squib, said first and second squibs being capable of actuation by voltages of the same polarity.

2. A multiple payload cartridge as described in claim 1, wherein said switch includes a delay element so that said second squib is not enabled until after a predetermined period following the first applied pulse.

3. A multiple payload cartridge as claimed in claim 1, wherein the actuation of said sensor is on the trailing end of the first pulse.

4. A multiple payload cartridge connectable for separate ignition of the payloads therein through two connecting wires, comprising:

a first expendable payload within the cartridge including a first squib, a second expendable payload within the cartridge including a second squib, ignition means pulsed through the connecting wires connected to said first and second squibs including means for disenabling said second squib from ignition by an applied first pulse thereto suitable for igniting said first squib and enabling said second squib for ignition by an applied second pulse, and said ignition means including a switch through which the ignition pulses are applied, said switch being initially connected to said first squib and disconnected from said second squib and being operable by the first applied pulse to be connected to said second squib, said switch including a pyrotechnic delay column ignited by the first applied pulse which, following the pyrotechnic delay, repositions said switch to enable said second squib for pulse ignition by a second applied pulse.

5. A multiple payload cartridge connectable for separate ignition of the payloads therein through two connecting wires, comprising:

a first expendable payload within the cartridge including a first squib, a second expendable payload within the cartridge including a second squib, ignition means pulsed through the connecting wires connected to said first and second squibs including means for disenabling said second squib from ignition by an applied first pulse thereto suitable for igniting said first squib and enabling said second squib for ignition by an applied second pulse, and said first squib being connected directly to the connecting wires and including a mechanical interrupter for connecting said second squib to the connecting wires, said interrupter being resiliently held open by the presence of said first payload, the ejection thereof closing said interrupter.

6. A multiple payload cartridge as described in claim 5, wherein said mechanical interrupter includes a mechanical delay for closing of said interrupter following ejection of said first payload.

7. A multiple payload cartridge as described in claim 5, wherein said interrupter includes a reaction switch having a crushable element, the ignition of said first squib crushing the element and closing said interrupter.

8. A multiple payload cartridge as described in claim 5, wherein said interrupter includes a reaction switch having a domed pop element, the ignition of said first squib popping said element to close said interrupter.

9. A multiple payload cartridge connectable for separate ignition of the payloads therein through two connecting wires, comprising:

a first expendable payload within the cartridge including a first squib, a second expendable payload within the cartridge including a second squib, a third expendable payload within the cartridge including a third squib connected to an ignition means, ignition means pulsed through the connecting wires connected to said first and second squibs including means for disenabling said second squib from ignition by an applied first pulse thereto suitable for igniting said first squib and enabling said second squib for ignition by an applied second pulse, and said ignition means including a diode in series with said second squib for blocking an applied first pulse of a first polarity while permitting ignition of said second squib with the application of a second pulse of a second polarity and including a second diode and a resistive element in series with said third squib for blocking an applied first pulse of a first polarity and for lowering an applied second polarity second pulse of low voltage suitable for igniting said second squib so as to prevent igniting said third squib therewith while permitting ignition of said third squib with the application of a second polarity third pulse of higher voltage.

10. A multiple payload cartridge connectable for separate ignition of the payloads therein through two connecting wires, comprising:

a first expendable payload within the cartridge including a first squib, a second expendable payload within the cartridge including a second squib, and ignition means pulsed through the connecting wires connected to said first and second squibs including means for disenabling said second squib from ignition by an applied first pulse thereto suitable for igniting said first squib and enabling said second squib for ignition by an applied second pulse, said ignition means including a resistive element in series with said second squib for lowering an applied first low voltage pulse suitable for igniting said first squib so as to prevent igniting said second squib therewith while permitting ignition of said second squib with the application of a second higher voltage pulse.

11. A multiple payload cartridge connectable for separate ignition of the payloads therein through two connecting wires, comprising:

a first expendable payload within the cartridge including a first squib, a second expendable payload within the cartridge including a second squib, a third expendable payload cartridge within the cartridge including a third squib, ignition means pulsed through the connecting wires connected to said first, second and third squibs, said ignition means including:

means for disenabling said second squib from ignition by an applied first pulse thereto suitable for igniting said first squib and enabling said second squib for ignition by an applied second pulse, a resistive element in series with said second squib for lowering an applied first low voltage pulse suitable for igniting said first squib so as to prevent igniting said second squib therewith while permitting ignition of said second squib with the application of a second higher voltage pulse, and a diode in series with said third squib for blocking an applied first and second pulse of a first polarity while permitting ignition of said third squib with the application of a third pulse of a second polarity.

12. A multiple payload cartridge as described in claim 11, and having a fourth expendable payload within the cartridge including:

a fourth squib connected to said ignition means, and wherein said ignition means includes a second diode and a second resistive element in series with the fourth squib for blocking said first and second applied pulses of a first polarity and said third pulse of a second polarity while permitting ignition of said fourth squib with the application of a fourth pulse of said second polarity higher in amplitude than said third pulse.

13. A multiple payload cartridge connectable for separate ignition of payloads therein through two connecting wires, comprising:

a first expendable payload within the cartridge including a first squib, a second expendable payload within the cartridge including a second squib, and ignition means connected through the connecting wires connected to said first and second squibs, including a resistive element in series with said second squib for lowering an applied first low voltage suitable for igniting said first squib so as to prevent igniting said second squib therewith while permitting ignition of said second squib with the application of a second higher voltage.

14. A multiple payload cartridge as described in claim 13, and having a third expandable payload within the cartridge including:

a third squib connected to said ignition means, and wherein said ignition means includes a second resistive element in series with said third squib for lowering said first and second voltages so as to prevent igniting said third squib therewith while permitting ignition of said third squib with the application of a third voltage higher than said second voltage.

* * * * *